US006265668B1

(12) United States Patent
Liu

(10) Patent No.: US 6,265,668 B1
(45) Date of Patent: Jul. 24, 2001

(54) PROTECTING DEVICE FOR PLUG

(76) Inventor: Hsin Liu, No. 4, Alley 40, Lane 629, Nei Hu 1 Section, Taipei (TW)

( * ) Notice: Subject to any disclaimer, the term of this patent is extended or adjusted under 35 U.S.C. 154(b) by 0 days.

(21) Appl. No.: 09/356,369

(22) Filed: Jul. 19, 1999

(51) Int. Cl.[7] ..... H01B 7/00
(52) U.S. Cl. ..... 174/135; 439/447
(58) Field of Search ..... 439/447, 448, 439/445; 174/135

(56) References Cited

U.S. PATENT DOCUMENTS 2,727,088 * 12/1955 Wall ..... 174/135
3,395,244 * 7/1968 Koehler ..... 174/135
3,800,068 * 3/1974 Torgerson ..... 174/135
5,823,817 * 10/1998 Pyle ..... 439/448
5,874,709 * 2/1999 New et al. ..... 219/137.9

* cited by examiner

*Primary Examiner*—Shawn Riley
(74) *Attorney, Agent, or Firm*—Rosenberg, Klein & Lee

(57) ABSTRACT

A protecting device for a plug is disclosed. The plug has a lead-out line electrically connected with a conductive wire. The conductive wire is enclosed by a cladding. A spiral ribbon is arranged on the outer surface of the conductive wire and on the junction between the lead-out line of the plug and the conductive wire. The spiral ribbon can provide smooth bending of the conductive wire when the conductive wire is pulled in arbitrary direction and prevent the breaking of the copper coil within the conductive wire.

1 Claim, 7 Drawing Sheets

PROTECTING DEVICE FOR PLUG

FIELD OF THE INVENTION

The present invention relates to a protecting device for plug, especially to a protecting device for the lead-out line of various plug, whereby the accuracy of test and the endurance of the plug are enhanced.

BACKGROUND OF THE INVENTION

FIGS. 1 and 2 show a conventional protecting device of the lead-out line 11*a* of a plug 10*a*. The lead-out line 11*a* of the plug 10*a* is electrically connected to a conductive wire 12*a*. To prevent the over-bending on the junction of the lead-out line 11*a* of the plug 10*a* and the conductive wire 12*a*, a protecting device composed of circular ribbons 14*a* and axial ribbons 15*a* are provided on the outer surface of the cladding over the part of the conductive wire 12*a* in connection with the lead-out line 11*a* of the plug 10*a*. As shown in FIG. 2, the circular ribbons 14*a* and axial ribbons 15*a* can prevent over-bending of the junction between the lead-out line 11*a* of the plug 10*a* and the conductive wire 12*a*, when the lead-out line 1 a is bent with respect to the conductive wire 12*a*.

However, as shown in FIG. 2, a sharp curve is easy to form on portion 16*a* of the conductive wire 12*a* adjoining to the protecting device when the conductive wire 12*a* is pulled out. The copper coil of the conductive wire 12*a* in the portion 16*a* is liable to break due to the sharp curve, thus reducing the endurance of the conductive wire 12*a* and the plug 10*a*.

It is the primary object of the present invention to provide a protecting device for the lead-out line of various plugs, whereby the accuracy of test and the durability of the plug are enhanced.

To achieve the above object, the present invention provides a spiral ribbon as protecting means around the cladding on the junction of the lead-out line and the conductive wire, the spiral ribbon keeping the smooth bending of the conductive wire and preventing the breakage of the upper coil within the conductive wire. the spiral ribbon can prevent the forming of sharp bending between the lead-out line of the plug and the conductive wire when the conductive wire is pulled out. Therefore, the accuracy of test and the endurance of the plug are enhanced.

The various objects and advantages of the present invention will be more readily understood from the following detailed description when read in conjunction with the appended drawing, in which:

DETAIL DESCRIPTION OF PREFERRED EMBODIMENT

Figure 1:
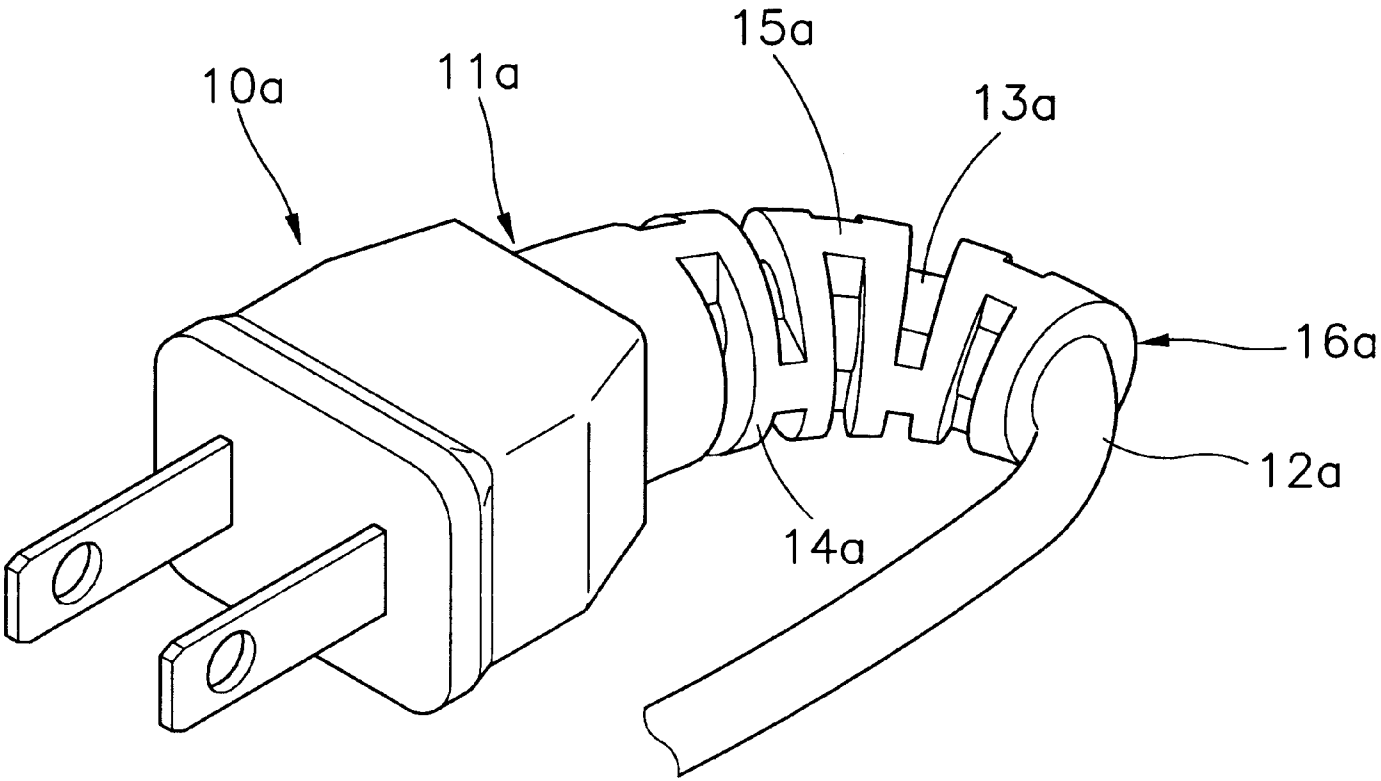
FIG. 1 PRIOR ART
FIG. 1 is a perspective view of the lead-out line of a conventional plug in bending state.
Figure 2:
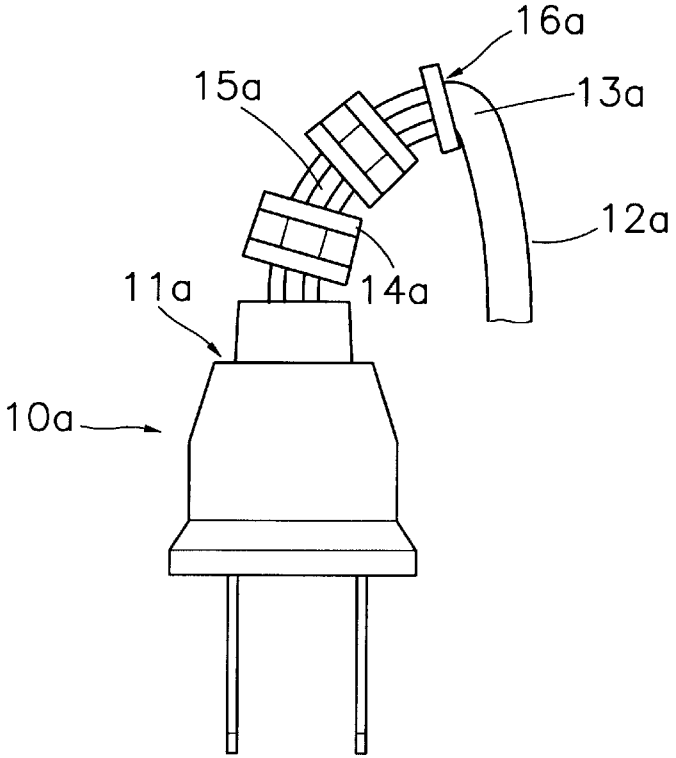
FIG. 2 PRIOR ART
FIG. 2 is a cross section view of the lead-out line of a conventional plug in bending state.
Figure 3:
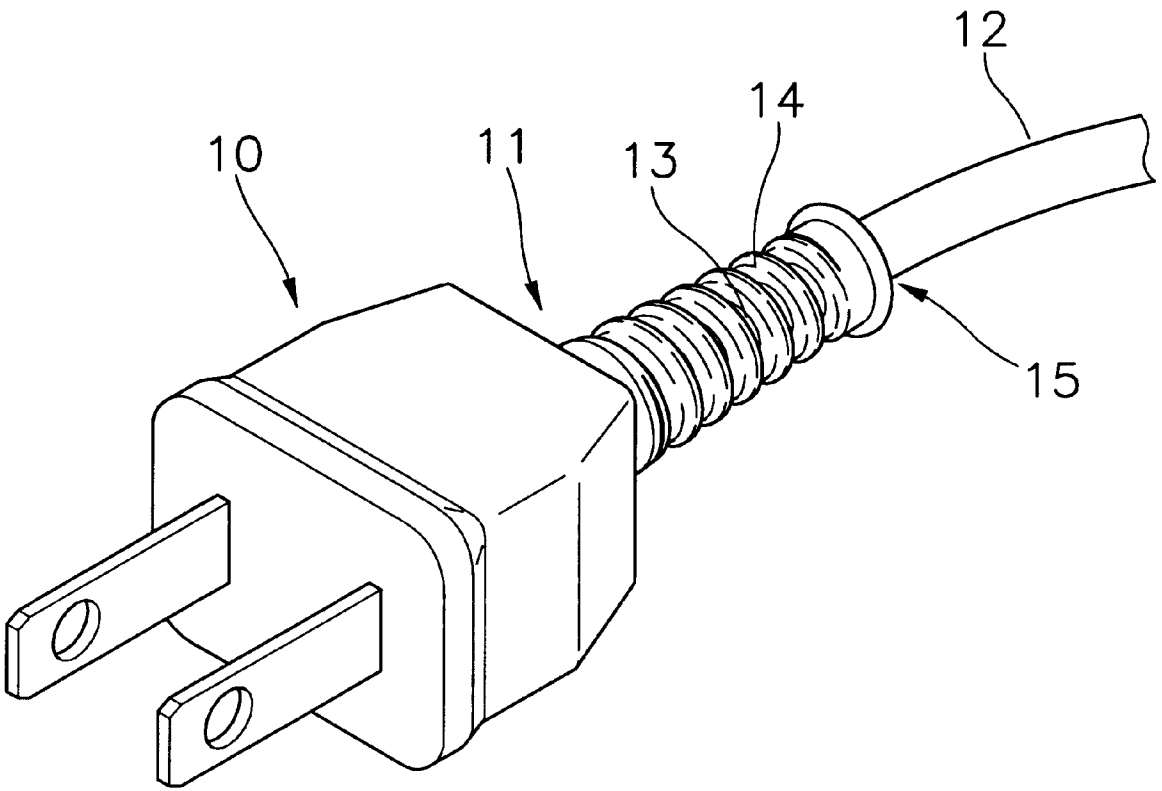
FIG. 3 is the perspective view of the first preferred embodiment according to the present invention.
Figure 6:
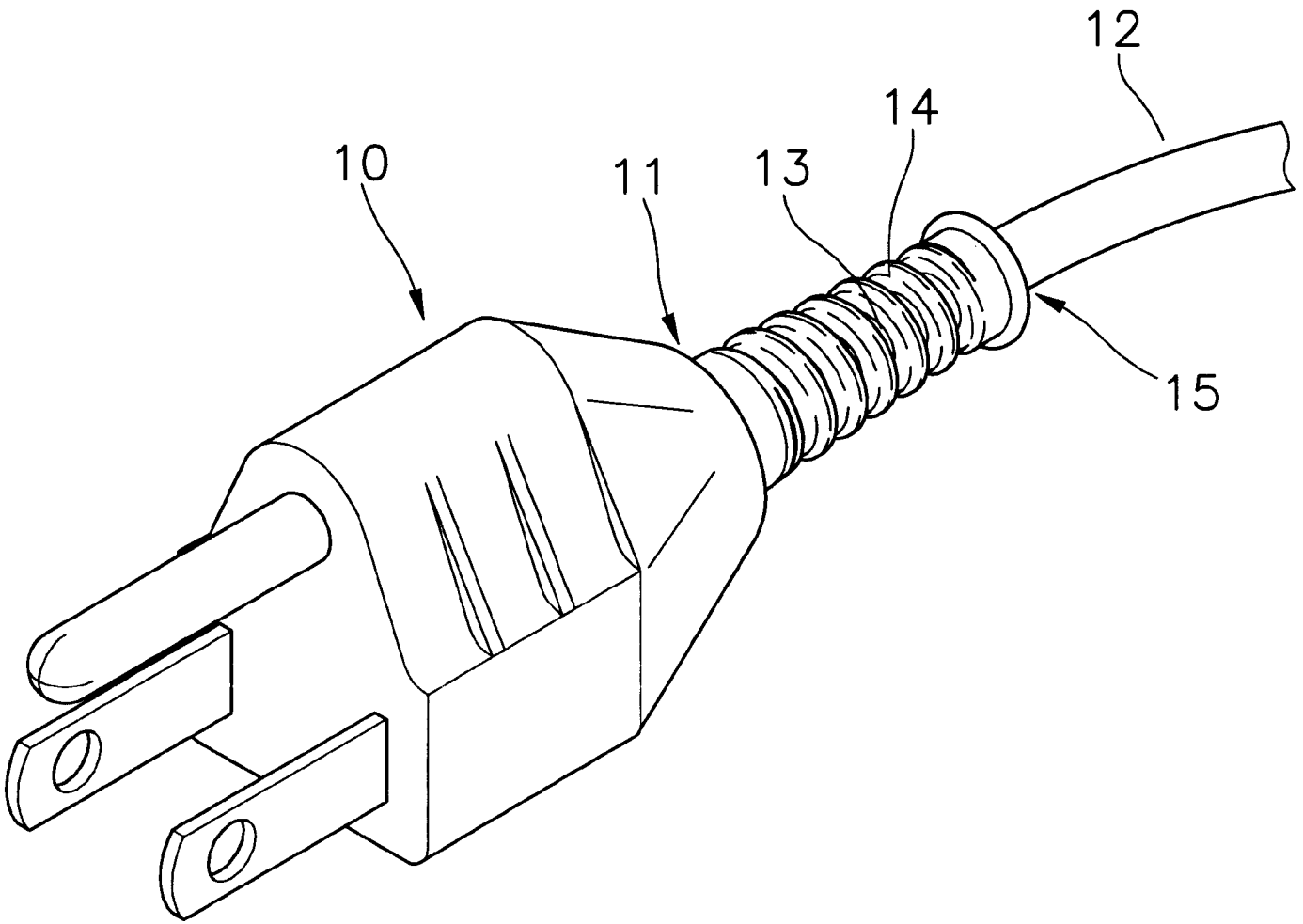
FIG. 6 is the perspective view of the second preferred embodiment according to the present invention.
Figure 7:
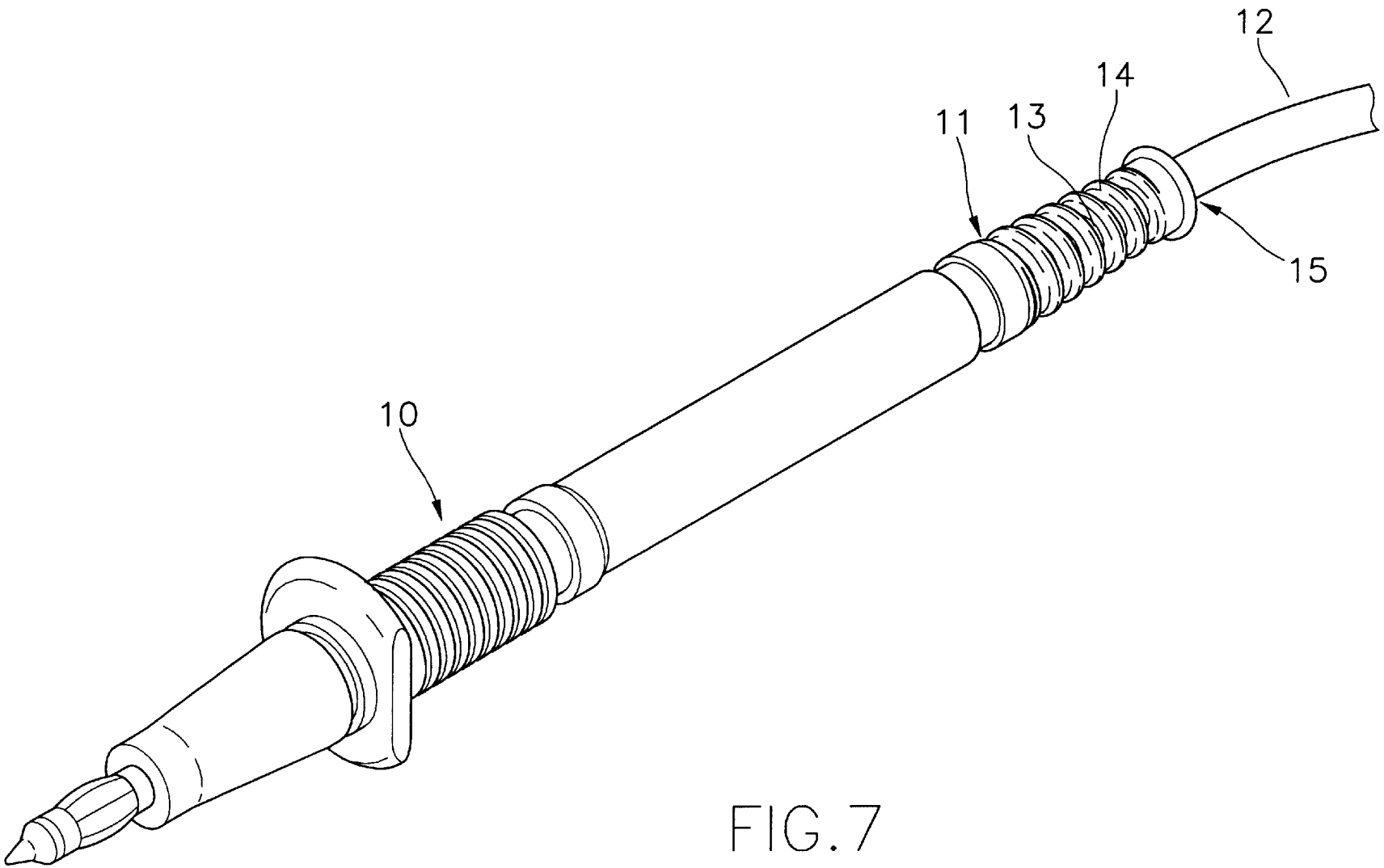
FIG. 7 is the perspective view of the third preferred embodiment according to the present invention.

As shown in FIG. 3, the present invention provides a protecting device of the lead-out line 11 of plug 10. The plug 10 can be of various type as that shown in FIG. 6 and the plug for multi-purpose meter as shown in FIG. 7. The rear side of the plug 10 is connected with a lead-out line 11, which is electrically connected to a conductive wire 12. The outer surface of the conductive wire 12 is enclosed by a cladding 13 made of insulating material. The conductive wire 12 includes copper coil therein (not shown). The present invention is characterized in that a spiral ribbon 14 is provided on the outer surface of the cladding 13 to provide a protecting means for the plug 10. More particularly, the spiral ribbon 14 is arranged on the junction between the lead-out line 11 of the plug 10 and the conductive wire 12, and is preferably formed integrally on the conductive wire 12. Moreover, the spiral ribbon 14 can also be mounted with the conductive wire 12 by assembling.

Figure 4:
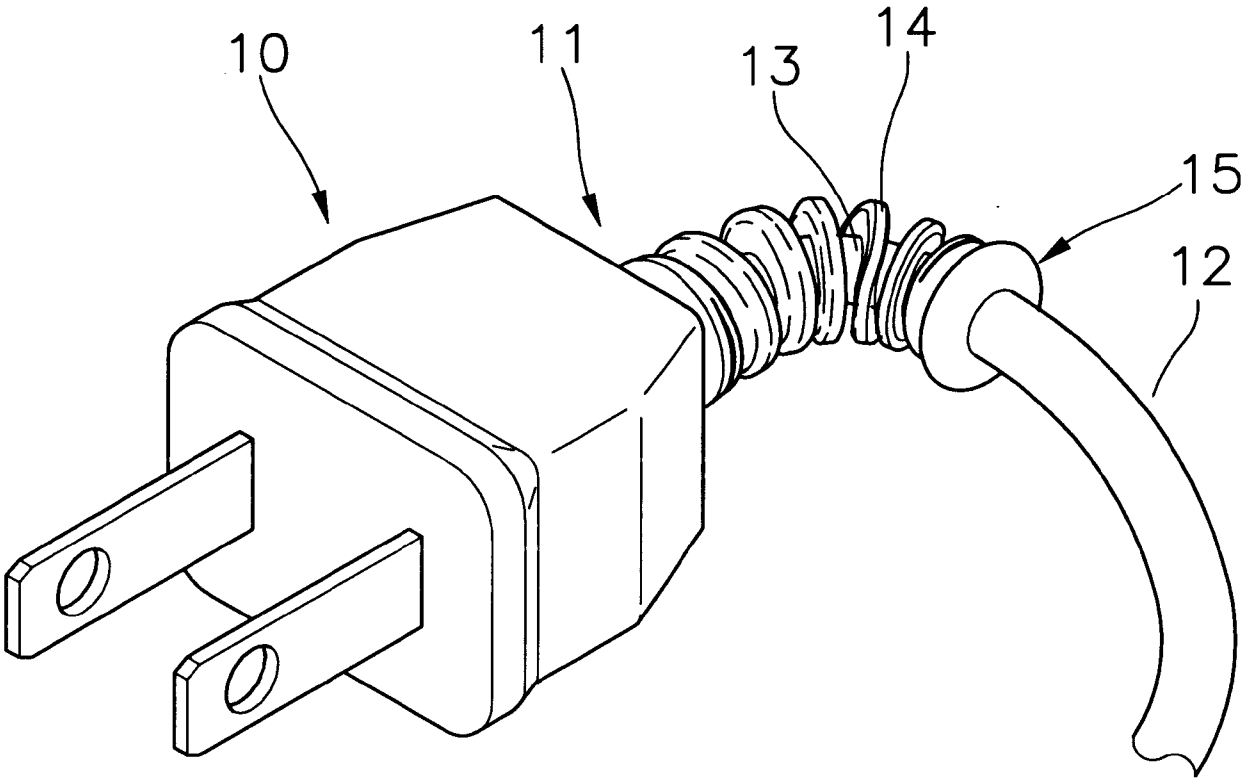
FIG. 4 is the perspective view of the first preferred embodiment according to the present invention in bending state.
Figure 5:
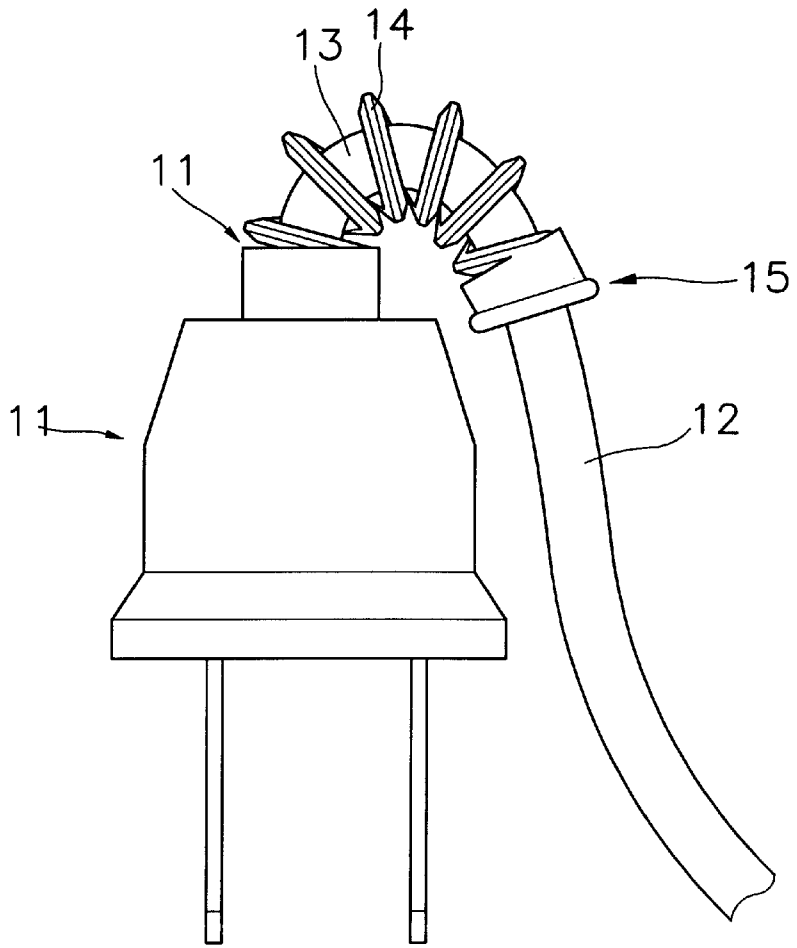
FIG. 5 is the cross section view of the first preferred embodiment according to the present invention in bending state.

As shown in FIGS. 4 and 5, the spiral ribbon 14 can prevent the over bending of the conductive wire 12 or the sharp edge forming of the conductive wire 12 when the junction between the lead-out line 11 of the plug 10 and the conductive wire 12 is bent due to pulling force acted on the conductive wire 12. The spiral ribbon 14 can uniformly absorb the pulling force acted on the conductive wire 12 such that a smooth bending portion is formed on the junction of the lead-out line 11 of the plug 10 and the conductive wire 12, even though the conductive wire 12 is pulled. Therefore, a sharp bending will not be formed on the end 15 of the conductive wire 12 in connection with the spiral ribbon 14, and the copper coil within the conductive wire 12 has not the risk of breaking. The accuracy of test and the endurance of the plug are enhanced.

To sum up, the present invention provides a protecting device of the lead-out line of plug, which can prevent the sharp edge formed on the junction of the lead-out line and the conductive wire, whereby the accuracy of test and the endurance of the plug are enhanced.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A protectively reinforced plug assembly comprising:

(a) a plug having a lead out line portion;

(b) an axially extended conductive wire member electrically coupled to said lead out line portion of said plug, said conductive wire member having an outer cladding;

(c) a spiral ribbon formed integrally on at least a portion of said cladding of said conductive wire member to extend coaxially thereabout adjacent said plug lead out line portion, said spiral ribbon protectively accommodating flexible deflection of said conductive wire.

* * * * *